United States Patent [19]

Schaufele

[11] B 3,989,982

[45] *Nov. 2, 1976

[54] MULTIPLE GASEOUS DISCHARGE DISPLAY/MEMORY PANEL HAVING DECREASED OPERATING VOLTAGES

[75] Inventor: Robert F. Schaufele, Okemos, Mich.

[73] Assignee: Owens-Illinois, Inc., Toledo, Ohio

[ * ] Notice: The portion of the term of this patent subsequent to Nov. 5, 1991, has been disclaimed.

[22] Filed: Apr. 23, 1974

[21] Appl. No.: 463,322

[44] Published under the second Trial Voluntary Protest Program on January 20, 1976 as document No. B 463,322.

Related U.S. Application Data

[63] Continuation of Ser. No. 67,604, Aug. 27, 1970, Pat. No. 3,846,670.

[52] U.S. Cl. ..... 315/169 TV; 313/95; 315/169 R

[51] Int. Cl.[2] ..... H05B 37/00

[58] Field of Search ..... 313/54, 95, 106; 315/169 TV, 169 R

[56] References Cited

UNITED STATES PATENTS

| | | | |
|---|---|---|---|
| 2,295,626 | 9/1942 | Beese | 313/112 |
| 2,919,361 | 12/1959 | Tschakert | 313/54 |
| 3,244,922 | 4/1966 | Wolfgang | 313/95 |
| 3,334,269 | 8/1967 | Heureaux | 315/169 X |
| 3,499,167 | 3/1970 | Baker | 315/169 |
| 3,513,327 | 5/1970 | Johnson | 307/89 |
| 3,599,029 | 8/1971 | Martyny | 313/489 |
| 3,846,670 | 11/1974 | Schaufele | 315/169 TV |

FOREIGN PATENTS OR APPLICATIONS

| | | |
|---|---|---|
| 1,168,460 | 10/1969 | United Kingdom |
| 1,209,657 | 1/1966 | United Kingdom |

OTHER PUBLICATIONS

Holland, Vacuum Deposition of Thin Films –Published by Chapman & Hall, Ltd., London, p. 460, 1961.

Bitzer, D. L. and Slottow, H. G. –"The Plasma Display Panel–A Digitally Addressable Display with Inherent Memory" Proceedings of the Full Joint Computer Conference–San Francisco, Nov. 1966.

Arora, B. M., Bitzer, D. L., Slottow, H. G. & Wilson, R. H. –"The Plasma Display Panel–A New Device for Information and Storage," Proceedings of the Eighth National Sympsium for Information Display–May 1967.

Bitzer, D. L. & Slottow, H. G. –"The Plasma Display Panel–A New Device for Direct View of Graphics"–Conference on Emerging Concepts in Computer Graphics, Univ. of Ill., Nov. 1967.

Bitzer, D. L. & Slottow, H. G. –"Principles and Applications of the Plasma Display Panel," Proceedings of the Oar Research Applications Conference Office of Aerospace Research, Arlington, Va., Mar. 1968–also Proceedings of Microelectronics Symposium, I.E.E.E., 6/68.

*Primary Examiner*—R. V. Rolinec
*Assistant Examiner*—Lawrence J. Dahl
*Attorney, Agent, or Firm*—David. H. Wilson, Jr.

[57] ABSTRACT

There is disclosed a multiple gaseous discharge display/memory panel having an electrical memory and capable of producing a visual display, the panel being characterized by an ionizable gaseous medium in a gas chamber formed by a pair of opposed dielectric material charge storage members which are respectively backed by a series of parallel-like conductor (electrode) members, the conductor members behind each dielectric material member being transversely oriented with respect to the conductor members behind the opposing dielectric material member so as to define a plurality of discrete discharge volumes constituting a discharge unit, the dielectric having at least one electron emissive substance applied to the surface thereof in an amount sufficient to decrease the operating voltages of the panel. Typical electron emissive substances contemplated include Group IA elements, Group IA oxides, barium, GaAs, GaP, InAs, InSb, InP, NiO, CsF, CsI, AgOCs, and AuOCs.

5 Claims, 5 Drawing Figures

Figure 2:
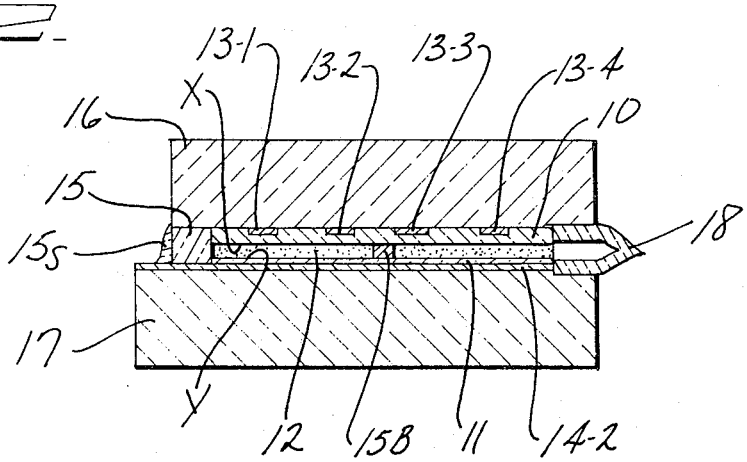

MULTIPLE GASEOUS DISCHARGE DISPLAY/MEMORY PANEL HAVING DECREASED OPERATING VOLTAGES

This application is a continuation of my copending application Ser. No. 67,604 filed Aug. 27, 1970, now U.S. Pat. No. 3,846,670.

THE INVENTION

This invention relates to novel multiple gas discharge display/memory panels which have an electrical memory and which are capable of producing a visual display or representation of data such as numerals, letters, television display, radar displays, binary words, etc. More particularly, this invention relates to novel gas discharge display/memory panels having substantially lower operating voltages. As used herein, voltage is defined as any voltage required for operation of the panel including firing and sustaining voltages as well as any other voltages for manipulation of the discharge.

Multiple gas discharge display and/or memory panels of the type with which the present invention is concerned are characterized by an ionizable gaseous medium, usually a mixture of at least two gases at an appropriate gas pressure, in a thin gas chamber or space between a pair of opposed dielectric charge storage member which are backed by conductor (electrode) members, the conductor members backing each dielectric member being transversely oriented to define a plurality of discrete discharge volumes and constituting a discharge unit. In some prior art panels the discharge units are additionally defined by surrounding or confining physical structure such as by cells or apertures in perforated glass plates and the like so as to be physically isolated relative to other units. In either case, with or without the confining physical structure, charges (electrons, ions) produced upon ionization of the gas of a selected discharge unit, when proper alternating operating potentials are applied to selected conductors thereof, are collected upon the surfaces of the dielectric at specifically defined locations and constitute an electrical field opposing the electrical field which created them so as to terminate the discharge for the remainder of the half-cycle and aid in the initiation of a discharge on a succeeding opposite half-cycle of applied voltage, such charges as are stored constituting an electrical memory.

Thus, the dielectric layers prevent the passage of any conductive current from the conductor members to the gaseous medium and also serve as collecting surfaces for ionized gaseous medium charges (electrons, ions) during the alternate half-cycles of the A.C. operating potentials, such charges collecting first on one elemental or discrete dielectric surface area and then on the opposing elemental or discrete dielectric surface area on alternate half-cycles to constitute an electrical memory.

An example of a panel structure containing non-physically isolated or open discharge units is disclosed in U.S. Pat. No. 3,499,167 issued to Theodore C. Baker et al.

An example of a panel containing physically isolated units is disclosed in the article by D. L. Bitzer and H. G. Slottow entitled "The Plasma Display Panel — A Digitally Addressable Display With Inherent Memory", Proceeding of the Fall Joint Computer Conference, IEEE, San Francisco, California, Nov. 1966, pages 541–547.

In the operation of the panel, a continuous volume of ionizable gas is confined between a pair of electron emissive dielectric surfaces backed by conductor arrays forming matrix elements. The cross conductor arrays may be orthogonally related (but any other configuration of conductor arrays may be used) to define a plurality of opposed pairs of charge storage areas on the surfaces of the dielectric bounding or confining the gas. Thus, for a conductor matrix having H rows and C columns the number of elemental discharge volumes will be the product H × C and the number of elemental or discrete areas will be twice the number of elemental discharge volumes.

The gas is one which produces light (if visual display is an objective) and a copious supply of charges (ions and electrons) during discharge. In an open-cell Baker et al. type panel, the gas pressure and the electric field are sufficient to laterally confine charges generated on discharge within elemental or discrete volumes of gas between opposed pairs of elemental or discrete dielectric areas within the perimeter of such areas, especially in a panel containing non-isolated units.

As described in the Baker et al patent, the space between the dielectric surfaces occupied by the gas is such as to permit photons generated on discharge in a selected discrete or elemental volume of gas to pass freely through the gas space and strike surface areas of dielectric remote from the selected discrete volumes, such remote, photon struck dielectric surface areas thereby emitting electrons so as to condition other and more remote elemental volumes for discharges at a uniform applied potential.

With respect to the memory function of a given discharge panel, the allowable distance or spacing between the dielectric surfaces depends, inter alia, on the frequency of the alternating current supply, the distance typically being greater for lower frequencies.

While the prior art does disclose gaseous discharge devices having externally positioned electrodes for initiating a gaseous discharge, sometimes called "electrodeless discharges," such prior art devices utilize frequencies and spacings or discharge volumes and operating pressures such that although discharges are initiated in the gaseous medium, such discharges are ineffective or not utilized for charge generation and storage in the manner of the present invention.

The term "memory margin" is defined herein as $$M.M. = \frac{V_f - V_s}{V_s}$$

where $V_f$ is the magnitude of the applied voltage at which a discharge is initiated in a discrete conditioned (as explained in the aforementioned Baker et al. patent) volume of gas defined by common areas of overlapping conductors and $V_s$ is the magnitude of the minimum applied periodic alternating voltage sufficient to sustain discharges once initiated. It will be understood that basic electrical phenomena utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, one discharge for each half-cycle of applied alternating sustaining voltage, once the elemental gas volume has been fired, to maintain alternate storing of charges at pairs of opposed discrete areas on the dielectric surfaces.

The above, as well as other objects, features and advantages of the invention will become apparent and better understood by reference to the following detailed description when considered in connection with the accompanying drawings. FIGS. 1 – 4 and the description of these figures are from the above mentioned Baker et al. U.S. Pat. No. 3,499,167.

Figure 1:
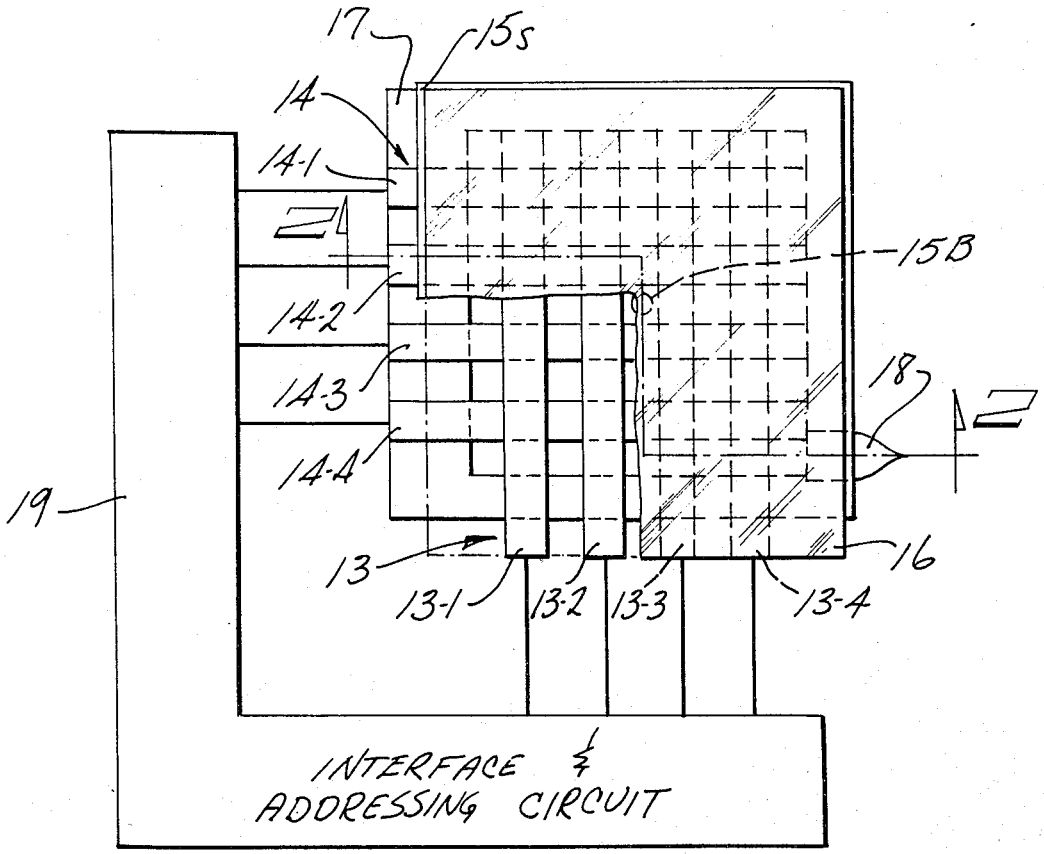
Figure 3:
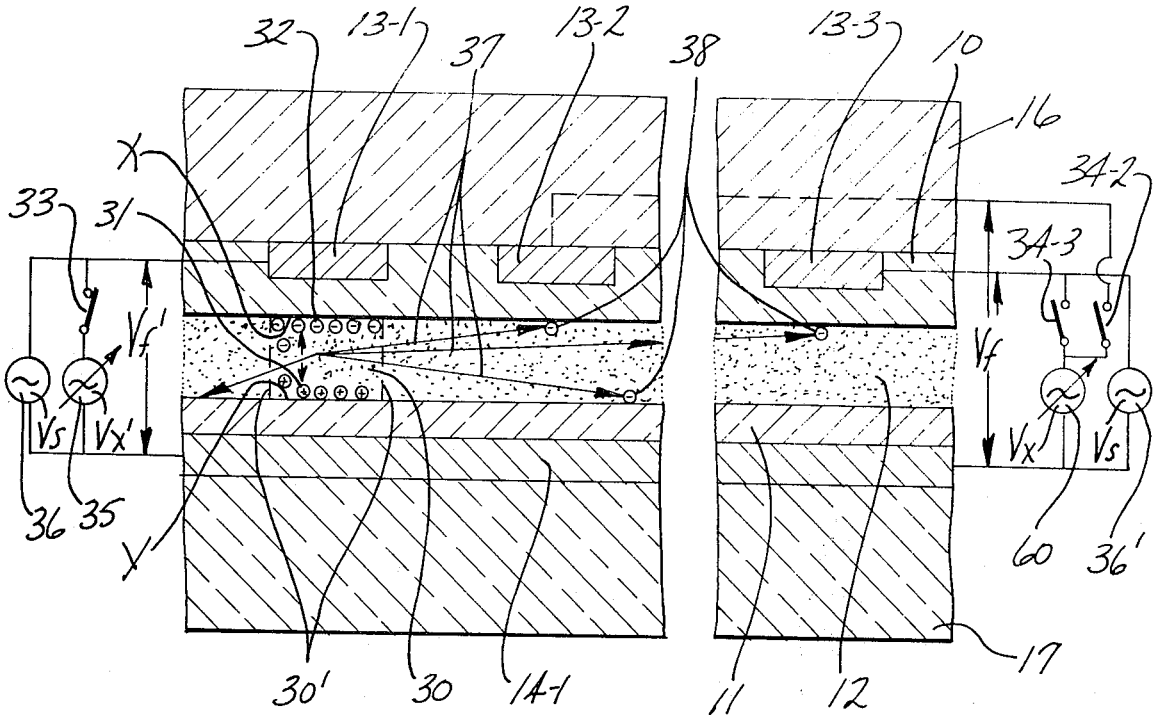
Figure 4:
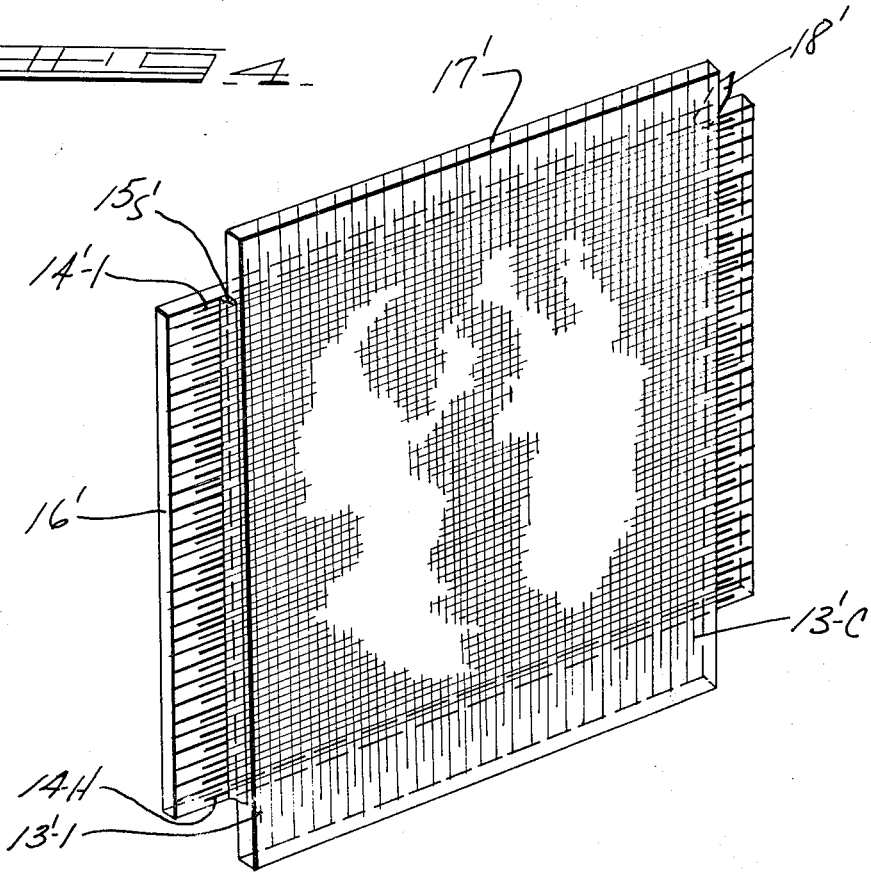
Figure 5:
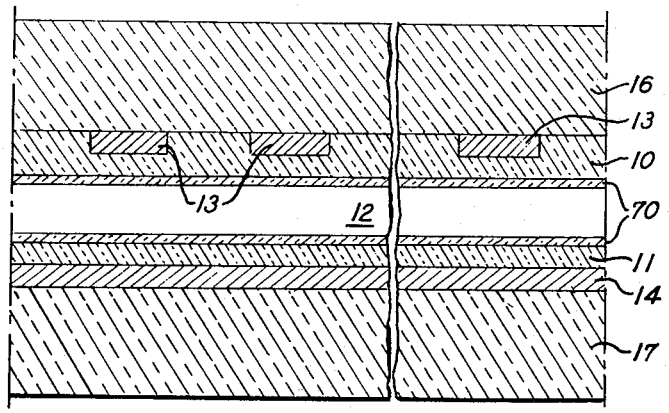

FIG. 1 is a partially cut-away plan view of a gaseous discharge display/memory panel embodying the invention as connected to a diagrammatically illustrated source of operating potentials, FIG. 2 is a cross-sectional view (enlarged, but not to proportional scale since the thickness of the gas volume, dielectric members and conductor arrays have been enlarged for purposes of illustration) taken on the lines 2—2 of FIG. 1, FIG. 3 is an explanatory partial cross-sectional view similar to FIG. 2 (enlarged, but not to proportional scale), FIG. 4 is an isometric view of a larger gaseous discharge display/memory panel incorporating the invention, and FIG. 5 is an explanatory partial cross-sectional view similar to FIG. 3 (enlarged, but not to proportional scale) illustrating the present invention.

The invention utilizes a pair of dielectric films or coatings 10 and 11 separated by a thin layer or volume of a gaseous discharge medium 12, said medium 12 producing a copious supply of charges (ions and electrons) which are alternately collectable on the surfaces of the dielectric members at opposed or facing elemental or discrete areas X and Y defined by the conductor matrix on nongas-contacting sides of the dielectric members, each dielectric member presenting large open surface areas and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by rigid nonconductive support members 16 and 17 respectively. Preferably, one or both of nonconductive support members 16 and 17 pass light produced by discharge in the elemental gas volumes. Preferably, they are transparent glass members and these members essentially define the overall thickness and strength of the panel. For example, the thickness of gas layer 12 as determined by spacer 15 is under 10 mils and preferably about 5 to 6 mils, dielectric layers 10 and 11 (over the conductors at the elemental or discrete X and Y areas) is between 1 and 2 mils thick, and conductors 13 and 14 about 8,000 angstroms thick (tin oxide). However, support members 16 and 17 are much thicker (particularly larger panels) so as to provide as much ruggedness as may be desired to compensate for stresses in the panel. Support members 16 and 17 also serve as heat sinks for heat generated by discharges and thus minimize the effect of temperature on operation of the device. If it is desired that only the memory function be utilized, then none of the members need be transparent to light although for purposes described later herein it is preferred that one of the support members and members formed thereon be transparent to or pass ultraviolet radiation.

Except for being nonconductive or good insulators the electrical properties of support members 16 and 17 are not critical. The main function of support members 16' and 17 is to provide mechanical support and strength for the entire panel, particularly with respect to pressure differential acting on the panel and thermal shock. As noted earlier, they should have thermal expansion characteristics substantially matching the thermal expansion characteristics of dielectric layers 10 and 11. Ordinary ¼ inch commercial grade soda lime plate glasses have been used for this purpose. Other glasses such as low expansion glasses or transparent devitrified glasses can be used provided they can withstand processing and have expansion characteristics substantially matching expansion characteristics of the dielectric coatings 10 and 11. For given pressure differentials and thickness of plates the stress and deflection of plates may be determined by following standard stress and strain formulas (see R. J. Roark, Formulas for Stress and Strain, McGraw-Hill, 1954).

Spacer 15 may be made of the same glass material as dielectric films 10 and 11 and may be an integral rib formed on one of the dielectric members and fused to the other members to form a bakeable hermetic seal enclosing and confining the ionizable gas volume 12. However, a separate final hermetic seal may be effected by a high-strength devitrified glass sealant 15S. Tubulation 18 is provided for exhausting the space between dielectric members 10 and 11 and filling that space with the volume of ionizable gas. For large panels small bead-like solder glass spacers such as shown at 15B may be located between conductors intersections and fused to dielectric members 10 and 11 to aid in withstanding stress on the panel and maintain uniformity of thickness of gas volume 12.

Conductor arrays 13 and 14 may be formed on support members 16 and 17 by a number of well known processes, such as photoetching, vacuum deposition, stencil screening, etc. In the panel shown in FIG. 4, the center spacing of conductors in the respective arrays is about 30 mils. Transparent or semitransparent conductive material such as tin oxide, gold or aluminum can be used to form the conductor arrays and should have a resistance less than 3000 ohms per line. It is important to select a conductor material that is not attacked during processing by the dielectric material.

It will be appreciated that conductor arrays 13 and 14 may be wires or filaments of copper, gold, silver or aluminum or any other conductive metal or material. For example, 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as an adherent film or coating which is not chemically or physically effected during bake-out of the panel. One such material is a solder glass such as Kimble SG-68 manufactured by and commercially available from the assignee of the present invention.

This glass has thermal expansion characteristics substantially matching the thermal expansion characteristics of certain soda-lime glasses, and can be used as the dielectric layer when the support members 16 and 17 are soda-lime glass plates. Dielectric layers 10 and 11 must be smooth and have a dielectric strength of about 1000 v. and be electrically homogeneous on a microscopic scale (e.g., no cracks, bubbles, crystals, dirt, surface films, etc). In addition, the surfaces of dielectric layers 10 and 11 should be good photoemitters of electrons in a baked out condition. However, a supply of free electrons for conditioning gas 12 for the ionization process may be provided by inclusion of a radioactive material within the glass or gas space. A preferred range of thickness of dielectric layers 10 and 11 overlying the conductor arrays 13 and 14 is between 1 and 2 mils. Of course, for an optical display at least one of dielectric layers 10 and 11 should pass light generated on discharge and be transparent or translucent and, preferably, both layers are optically transparent.

The preferred spacing between surfaces of the dielectric films is about 5 to 6 mils with conductor arrays 13 and 14 having center-to-center spacing of about 30 mils.

The ends of conductors 14-1 . . . 14-4 and support member 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As in known display systems, the interface and addressing circuitry or system 19 may be relatively inexpensive line scan systems or the somewhat more expensive high speed random access systems. However, it is to be noted that a lower amplitude of operating potentials helps to reduce problems associated with the interface circuitry between the addressing system and the display/memory panel per se. Thus, by providing a panel having greater uniformity in the discharge characteristics throughout the panel, tolerances and operating characteristics of the panel with which the interfacing circuitry cooperate, are made less rigid.

One mode of initiating operation of the panel will be described with reference to FIG. 3, which illustrates the condition of one elemental gas volume 30 having an elemental cross-sectional area and volume which is quite small relative to the entire volume and cross-sectional area of gas 12. The cross-sectional area of volume 30 is defined by the overlapping common elemental areas of the conductor arrays and the volume is equal to the product of the distance between the dielectric surfaces and the elemental area. It is apparent that if the conductor arrays are uniform and linear and are orthogonally (at right angles to each other) related each of elemental areas X and Y will be squares and if conductors of one conductor array are wider than conductors of the other conductor array, said areas will be rectangles. If the conductor arrays are at transverse angles relative to each other, other than 90°, the areas will be diamond shaped so that the cross-sectional shape of each volume is determined solely in the first instance by the shape of the common area of overlap between conductors in the conductor arrays 13 and 14. The dotted lines 30 are imaginary lines to show a boundary of one elemental volume about the center of which each elemental discharge takes place. As described earlier herein, it is known that the cross-sectional area of the discharge in a gas is affected by, inter alia, the pressure of the gas, such that, if desired, the discharge may even be constricted to within an area smaller than the area of conductor overlap. By utilization of this phenomena, the light production may be confined or resolved substantially to the area of the elemental cross-sectional area defined by conductor overlap. Moreover, by operating at such pressure charges (ions and electrons) produced on discharge are laterally confined so as to not materially affect operation of adjacent elemental discharge volumes.

In the instant shown in FIG. 3, a conditioning discharge about the center of elemental volume 30 has been initiated by application to conductor 13-1 and conductor 14-1 firing potential $V_x'$ as derived from a source 35 of variable phase, for example, and source 36 of sustaining potential $V_s$ (which may be a sine wave, for example). The potential $V_x'$ is added to the sustaining potential $V_s$ as sustaining potential $V_s$ increases in magnitude to initiate the conditioning discharge about the center of elemental volume 30 shown in FIG. 3. There, the phase of the source 35 of potential $V_x'$ has been adjusted into adding relation to the alternating voltage from the source 36 of sustaining voltage $V_s$ to provide a voltage $V_f'$, when switch 33 has been closed, to conductors 13-1 and 14-1 defining elementary gas volume 30 sufficient (in time and/or magnitude) to produce a light generating discharge centered about discrete elemental gas volume 30. At the instant shown, since conductor 13-1 is positive, electrons 32 have collected on and are moving to an elemental area of dielectric member 10 substantially corresponding to the area of elemental gas volume 30 and the less mobile positive ions 31 are beginning to collect on the opposed elemental area of dielectric member 11 since it is negative. As these charges build up, they constitute a back voltage opposed to the voltage applied to conductors 13-1 and 14-1 and serve to terminate the discharge in elemental gas volume 30 for the remainder of a half cycle.

During the discharge about the center of elemental gas volume 30, photons are produced which are free to move or pass through gas medium 12, as indicated by arrows 37, to strike or impact remote surface areas of photoemissive dielectric members 10 and 11, causing such remote areas to release electrons 38. Electrons 38 are, in effect, free electrons in gas medium 12 and condition each other discrete elemental gas volume for operation at a lower firing potential $V_f$ which is lower in magnitude than the firing potential $V_f'$ for the initial discharge about the center of elemental volume 30 and this voltage is substantially uniform for each other elemental gas volume.

Thus, elimination of physical obstructions or barriers between discrete elemental volumes, permits photons to travel via the space occupied by the gas medium 12 to impact remote surface areas of dielectric members 10 and 11 and provides a mechanism for supplying free electrons to all elemental gas volumes, thereby conditioning all discrete elemental gas volumes for subsequent discharges, respectively, at a uniform lower applied potential. While in FIG. 3, a single elemental volume 30 is shown, it will be appreciated that an entire row (or column) of elemental gas volumes may be maintained in a "fired" condition during normal operation of the device with the light produced thereby being masked or blocked off from the normal viewing area and not used for display purposes. It can be expected that in some applications there will always be at least one elemental volume in a "fired" condition and producing light in a panel, and in such application it is not necessary to provide separate discharge of generation of photons for purposes described earlier.

However, as described earlier, the entire gas volume can be conditioned for operation at uniform firing potentials by use of external or internal radiation so that there will be no need for a separate source of higher potential for initiating an initial discharge. Thus, by radiating the panel with ultraviolet radiation or by inclusion of a radioactive material within the glass materials or gas space, all discharge volumes can be operated at uniform potentials from addressing and interface circuit 19.

Since each discharge is terminated upon a build up or storage of charges at opposed pairs of elemental areas, the light produced is likewise terminated. In fact, light production lasts for only a small fraction of a half cycle of applied alternating potential and depending on design parameters, is in the nanosecond range.

After the initial firing or discharge of discrete elemental gas volume 30 by a firing potential $V_f'$, switch 33 may be opened so that only the sustaining voltage $V_s$ from source 36 is applied to conductors 13-1 and 14-1. Due to the storage of charges (e.g., the memory) at the opposed elemental areas X and Y, the elemental gas volume 30 will discharge again at or near the peak of negative half cycles of sustaining voltage $V_s$ to again produce a momentary pulse of light. At this time, due to reversal of field direction, electrons 32 will collect on and be stored on elemental surface area Y of dielectric member 11 and positive ions 31 will collect and be stored on elemental surface area X of dielectric member 10. After a few cycles of sustaining voltage $V_s$, the times of discharges become symmetrically located with respect to the wave form of sustaining voltage $V_s$. At remote elemental volumes, as for example, the elemental volumes defined by conductor 14-1 with conductors 13-2 and 13-3, a uniform magnitude or potential $V_x$ from source 60 is selectively added by one or both of switches 34-2 or 34-3 to the sustaining voltage $V_s$, shown as 36' to fire one or both of these elemental discharge volumes. Due to the presence of free electrons produced as a result of the discharge centered about elemental volume 30, each of these remote discrete elemental volumes have been conditioned for operation at uniform firing potential $V_f$.

In order to turn "off" an elemental gas volume (i.e. terminate a sequence of discharge representing the "on" state), the sustaining voltage may be removed. However, since this would also turn "off" other elemental volumes along a row or column, it is preferred that the volumes be selectively turned "off" by application to selected "on" elemental volumes a voltage which can neutralize the charges stored at the pairs of opposed elemental areas.

This can be accomplished in a number of ways, as for example, varying the phase or time position of the potential from source 60 to where that voltage combined with the potential form source 36' falls substantially below the sustaining voltage.

It is apparent that the plates 16-17 need not be flat but may be curved, curvature of facing surfaces of each plate being complementary to each other. While the preferred conductor arrangement is of the crossed grid type as shown herein, it is likewise apparent that where an infinite variety of two dimensional display patterns are not necessary, as where specific standardized visual shapes (e.g. numerals, letters, words, etc.) are to be formed and image resolution is not critical, the conductors may be shaped accordingly.

The device shown in FIG. 4 is a panel having a large number of elemental volumes similar to elemental volume 30 (FIG. 3). In this case more room is provided to make electrical connection to the conductor arrays 13' and 14', respectively, by extending the surfaces of support members 16' and 17' beyond seal 15S', alternate conductors being extended on alternate sides. Conductor arrays 13' and 14' as well as support members 16' and 17' are transparent. The dielectric coatings are not shown in FIG. 4 but are likewise transparent so that the panel may be viewed from either side.

In accordance with this invention, it has been surprisingly discovered that the operating voltage of a gaseous discharge panel may be significantly decreased by the application of at least one electron emissive substance to the surface of the dielectric material. More particularly, at least one electron emissive substance is applied to each dielectric charge storage surface of a gaseous discharge panel in an amount sufficient to provide substantially lower gaseous discharge panel operating voltages.

As used herein, electron emissive refers to the processes of photoemission, secondary electron emission of ion and/or electron bombardment, and thermionic electron emission.

In the practice of this invention, it is contemplated using at least one electron emissive substance selected from Group IA elements (lithium, sodium, potassium, rubidium, cesium, and francium); oxides of Group IA; barium; GaAs, GaP; InAs; InSb; InP, NiO; CsF; CsI; AgOCs; and AuOCs. In one specific embodiment hereof, there is used an electron emissive combination comprising at least one member selected from GaAs, GaP, InAs, InSb, or InP and one member selected from Cs or $Cs_2O$.

The selected electron emissive substance (or a source thereof) is applied to each dielectric surface by any convenient means including not by way of limitation vapor deposition; vacuum deposition; chemical vapor deposition; wet spraying upon the surface a mixture or solution of the substance (or source thereof) suspended or dissolved in a liquid followed by evaporation of the liquid; dry spraying of the substance upon the surface; electron beam evaporation; plasma flame and/or arc spraying and/or deposition; sputtering target techniques; application of the substance as a molten melt followed by cooling in an inert or oxidizing environment.

The selected electron emissive substance is applied to each dielectric surface as a very thin film or layer, the thickness of such film or layer being sufficient to provide substantially decreased panel operating voltages, usually at least about 100 angstrom units, typically at least about 1000 angstrom units. As used herein, the terms "film or layer" are inclusive of all similar terms such as deposit, coating, finish, spread, covering, etc. The thin film or layer 70 applied to the surface of each dielectric 10, 11 is shown in FIG. 5.

In one preferred embodiment hereof, the electron emissive substance is selected from Group IA alkali metals (as defined hereinbefore) and oxides of Group IA. In the practice of such embodiment, the Group IA metal or oxide thereof is applied to the dielectric surface by any convenient means (as defined hereinbefore), especially a molten melt technique. It is also contemplated that the Group IA oxide may be formed in situ on the surface of the dielectric, e.g. by applying a Group IA alkali metal to the surface followed by oxidation. One such in situ process comprises applying a Group IA melt to the dielectric followed by cooling in an oxygen rich environment. Another in situ process comprises applying an oxidizable source of the Group IA metal to the surface. Typical of such sources include minerals and/or compounds containing one or more Group IA metals, especially those inorganic or organic compounds which can be readily heat decomposed or pyrolyzed. However, as already noted, it is also contemplated that Group IA oxides may be directly used.

In the fabrication of a gaseous discharge panel, the dielectric material is typically applied to and cured on the surface of a supporting glass substrate or base to which the electrode or conductor elements have been previously applied. The glass substrate may be of any suitable composition such as a soda-lime glass composition. Two glass substrates containing electrodes and cured dielectric are then appropriately heat sealed together so as to form a panel.

In one embodiment of this invention, the selected electron emissive substance is applied to the surface of the cured dielectric before the panel heat-sealing cycle.

In another embodiment of this invention, the electron emissive substance is applied to the dielectric surfaces after the fabrication of the panel.

Depending upon the specific electron emissive substance or combinations thereof utilized, the practice of this invention may be especially beneficial over given periods of panel operating time; that is, best results may be realized after appropriate aging of the panel, the required amount of aging being a function of the electron emissive substance used. Panel aging is defined as the accumulated total operating time for the panel.

The following example is intended to illustrate one of the best embodiments contemplated by the inventor in the practice of this invention.

EXAMPLE

A gaseous discharge panel device of the Baker et al kind was constructed, e.g. as generally described hereinbefore. The panel dielectric composition was a lead borosilicate consisting of 73.3% by weight PbO, 13.4% by weight $B_2O_3$, and 13.3% by weight $SiO_2$. The panel glass substrates were of a soda-lime composition containing about 73% by weight $SiO_2$, about 13% by weight $Na_2O$, about 10% by weight CaO, about 3% by weight MgO, about 1% by weight $Al_2O_3$, and small amounts (less than 1%) of $Fe_2O_3$, $K_2O$, $As_2O_3$, and $Cr_3O_3$. The electrode lines or conductor arrays were of hanovia gold. The panel was filled with 363 torr of an inert ionizable gas consisting of 99.9% atoms of neon and 0.1% atom of argon.

A sealed elemental cesium metal reservoir was attached to the gas filling aperture so as to permit cesiation of the dielectric surfaces. The dielectric surfaces were heavily cesiated to a thickness of at least 100 angstrom units by opening the cesium reservoir, heating the metal to a molten state, and permitting the molten cesium to flow into the sealed, gas filled panel. The excess metal was drained from the panel.

Panel turn-on and turn-off voltages were measured for quarter areas of the panel utilizing a 50 KC sinusoidal sustaining voltage, before and after the addition of the cesium. The results, as shown in TABLE I, illustrate that the voltages were decreased by over 50% for the cesiated surface.

TABLE I

| | Turn-ON | Turn-Off |
|---|---|---|
| uncesiated surface | 132 ± 1 volts | 103 ± 1 volts |
| cesiated surface | 60 ± 1 volts | 48 ± 1 volts |

The memory margin of the panel was insensitive to cesiation, decreasing from 0.28 to 0.25. The uncesiated areas of the dielectric remained essentially at their higher initial voltage values.

Heating of the cesiated device from 298°K to 383°K, increased the partial pressure of the cesium metal from $10^{-6}$ to $10^{-2}$ torr, but produced no measurable change in the panel voltages, demonstrating that the voltage reductions in TABLE I are induced by the electron emissive cesiated surfaces.

I claim:

1. In a gaseous discharge display/memory device characterized by an ionizable gaseous medium in a gas chamber formed by a pair of dielectric material bodies having opposed charge storage surfaces, the improvement wherein each dielectric surface is coated with at least one electron emissive substance having a thickness of at least about 100 angstrom units to provide substantially decreased operating voltages without substantially affecting the memory margin of said device, said electron emissive substance being selected from Group IA elements, Group IA oxides, barium, GaAs, GaP, InAs, InSb, InP, NiO, CsF, CsI, AgOCs, and AuOCs.

2. The invention of claim 1 wherein the electron emissive substance is a combination of at least one member selected from the group consisting of GaAs, GaP, InAs, InSb and InP, and one member selected from the group consisting of Cs and $Cs_2O$.

3. The invention of claim 1 wherein the electron emissive substance is present on the dielectric charge storage surfaces in an amount sufficient to decrease the operating voltage of said device by at least 50 percent.

4. A gas discharge display/memory device comprising in combination, a pair of spaced-apart non-conductive support members, a pair of conductor arrays arranged one on each of the confronting surfaces of said support members, the arrays being in transverse relative orientation so as to provide a series of cross-points therebetween, each defining a discharge unit, a thin dielectric material coating on the confronting surfaces of each of the support members and conductor arrays defining therebetween a sealed gas chamber with said discharge units in open photonic communication, an ionizable gaseous medium contained in said chamber, said dielectric material coating being adapted to insulate said conductor arrays from said ionizable gaseous medium contained in said chamber and for storing charges emitted by gaseous discharge, and at least one electron emissive substance on the confronting surfaces of said dielectric material coatings, said electron emissive substance being present in an amount sufficient to provide substantially decreased operating voltages without substantially affecting the memory margin of said device.

5. The invention of claim 4 wherein the thickness of said electron emissive substance on said dielectric material coating is at least about 100 angstrom units.

* * * * *